US005275904A

United States Patent [19]

Shimizu et al.

[11] Patent Number: 5,275,904

[45] Date of Patent: Jan. 4, 1994

[54] START DEVELOPER AND METHOD OF CONTROLLING TONER DENSITY

[75] Inventors: Yoshitake Shimizu, Kyoto; Koichi Tsuyama, Kobe; Masahide Inoue, Kitakatsuragi; Tetsuya Nakano, Nabari, all of Japan

[73] Assignee: Mita Industrial Co., Ltd., Osaka, Japan

[21] Appl. No.: 8,338

[22] Filed: Jan. 25, 1993

Related U.S. Application Data

[62] Division of Ser. No. 698,785, May 13, 1991, Pat. No. 5,213,935.

[30] Foreign Application Priority Data

May 19, 1990 [JP] Japan ..... 2-129667

[51] Int. Cl.[5] ..... G03G 9/00

[52] U.S. Cl. ..... 430/109; 430/108; 430/110; 430/137; 355/208

[58] Field of Search ..... 355/208; 430/108, 109, 430/110, 137

[56] References Cited

U.S. PATENT DOCUMENTS 5,077,158 12/1991 Nakano ..... 430/109
5,077,168 12/1991 Ogami et al. ..... 430/109
5,077,169 12/1991 Inoue et al. ..... 430/109

FOREIGN PATENT DOCUMENTS 029584 6/1981 European Pat. Off. .
127916 12/1984 European Pat. Off. .
140996 5/1985 European Pat. Off. .
936255 5/1990 Fed. Rep. of Germany .

OTHER PUBLICATIONS

An English Abstract of Japanese Patent Publication No. 2-120879 to Kenji Urabe, entitled "Image Forming Device," corresponding to German Patent Publication No. DE-A-3 936 255.

*Primary Examiner*—Marion E. McCamish
*Assistant Examiner*—Mark A. Chapman
*Attorney, Agent, or Firm*—Beveridge, DeGrandi, Weilacher & Young

[57] ABSTRACT

The present invention provides a start developer wherein an output voltage of a sensor in the start developer having a particular toner density is not less than 0.9 times an output voltage of the sensor in a developer having the same toner density in a time period during which image characteristics are stabilized after repeating image formation by an image forming apparatus and is less than a threshold value at which the supply of toner is started and a method of controlling the toner density using the start developer. According to the present invention, good images can be always formed irrespective of the variation in characteristics between sensors in image forming apparatuses and from the early stage of image formation to the stable time period.

3 Claims, 8 Drawing Sheets

FIG. 2(a)
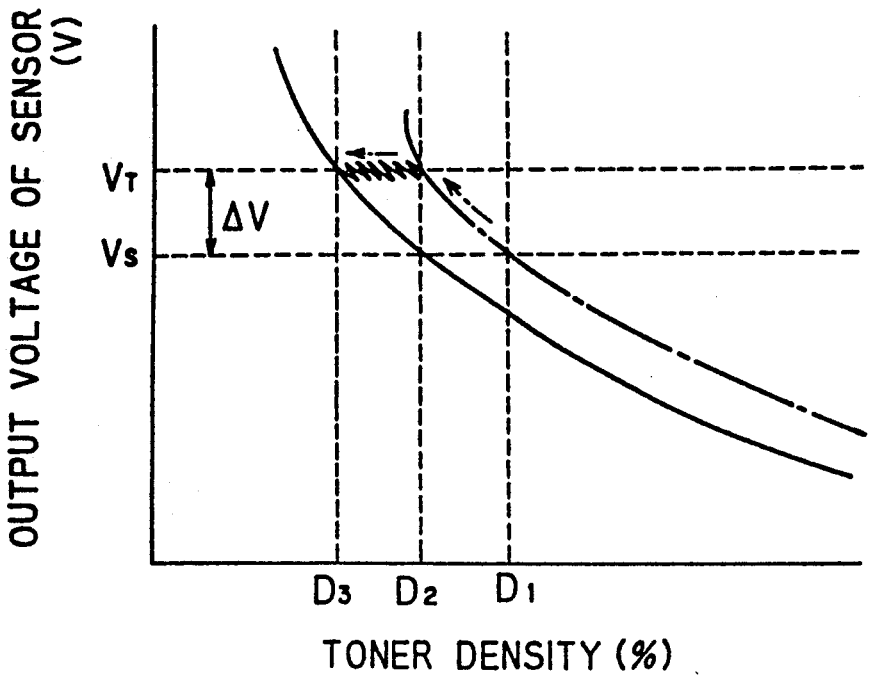
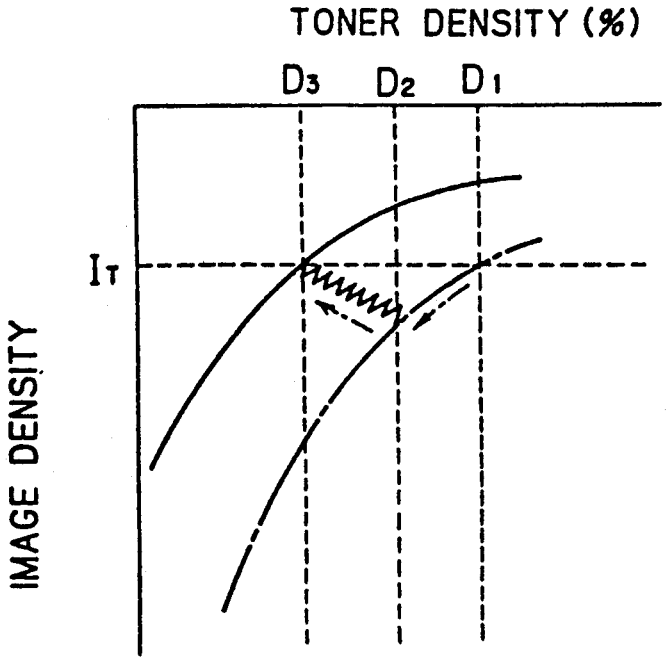
FIG. 2(b)

FIG. 7(a)
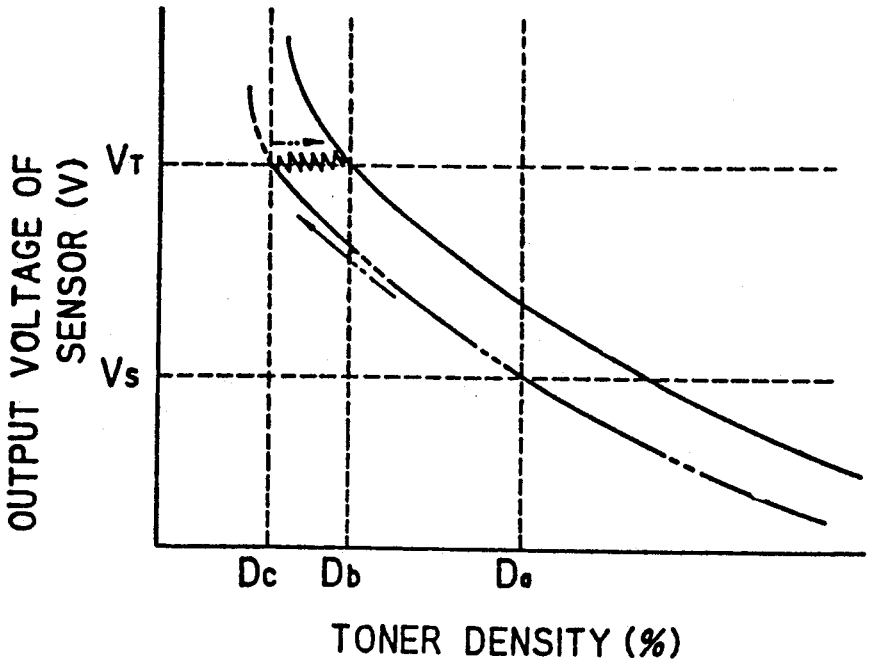
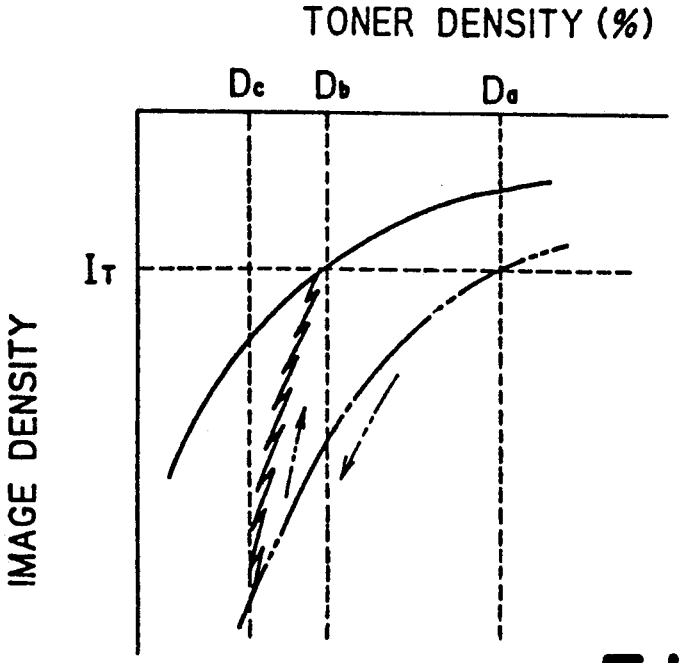
FIG. 7(b)

FIG. 8
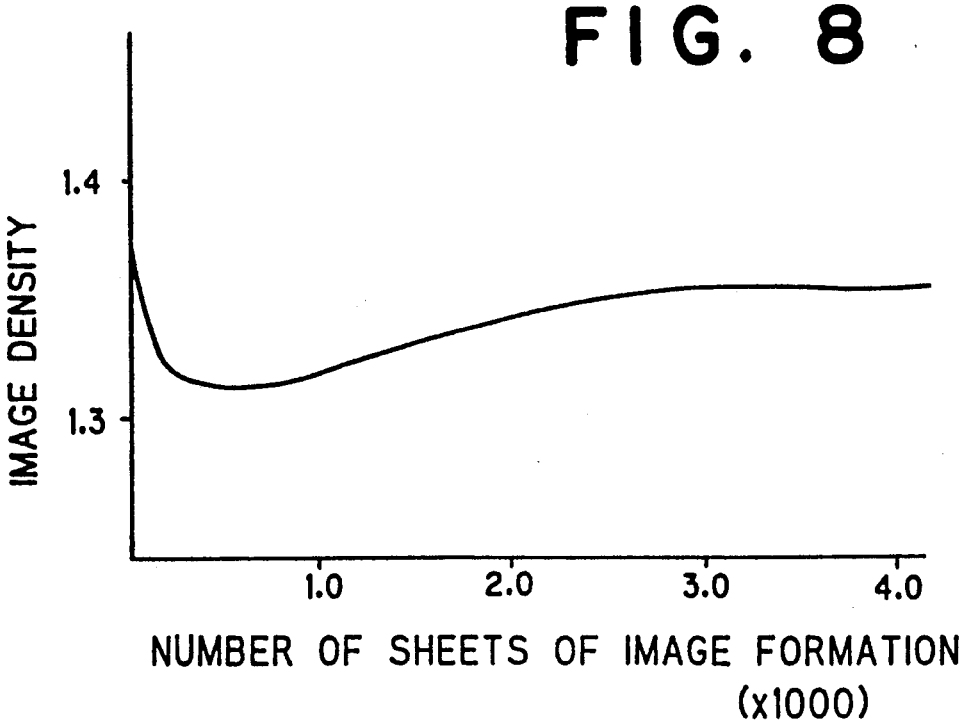
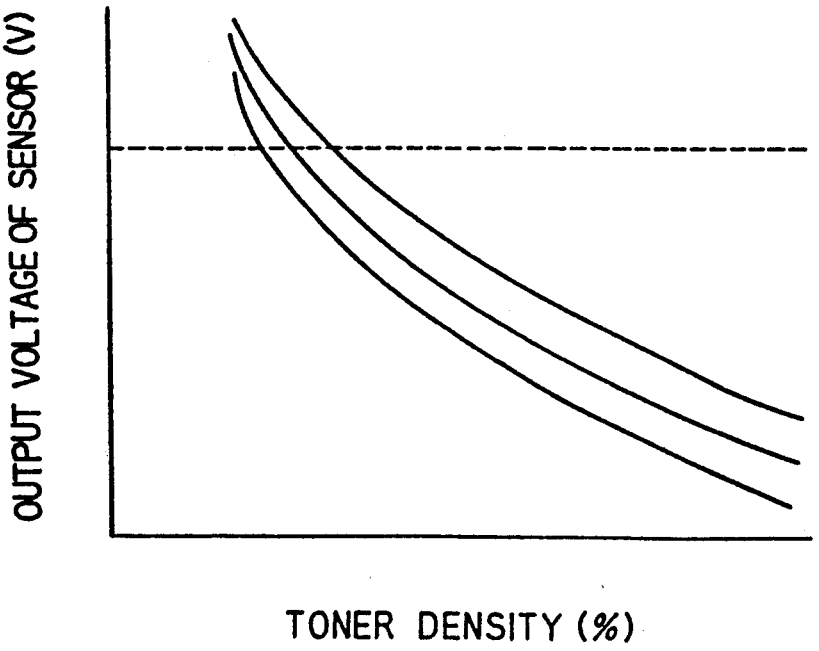
FIG. 9

START DEVELOPER AND METHOD OF CONTROLLING TONER DENSITY

This is a divisional of co-pending application Ser. No. 07/698,785 filed on May 13, 1991 now U.S. Pat. No. 5,213,935 which is entirely incorporated herein by reference.

BACKGROUND OF THE INVENTION

1. Field of the Invention

The present invention relates to a two-component start developer having toner and a carrier mixed with each other in a predetermined ratio which is used for an image forming apparatus utilizing a so-called electrophotographic method such as an electrostatic copying machine or a laser beam printer and a method of controlling the toner density in forming images usint the start developer.

2. Description of the Prior Art

In this electrophotographic method, a photoreceptor is first exposed to form an electrostatic latent image on its surface. A developer containing toner is then brought into contact with this electrostatic latent image, to develop this electrostatic latent image into a toner image. This toner image is transferred to the surfaces of paper sheets from the surface of the photoreceptor and is fixed to the surfaces of the paper sheets by, for example, applying pressure and heat.

As the developer used in the above described electrophotographic method, a two-component developer containing toner and a carrier is generally used. The carrier is made of a magnetic material such as ferrite powder and circulates in a developing device for developing an electrostatic latent image into a toner image with the toner being electrostatically adsorbed thereon.

A developer first used in newly manufacturing an image forming apparatus utilizing the above described electrophotographic method or after maintenance such as repair and a check of the image forming apparatus is one having toner and a carrier mixed with each other in a predetermined ratio according to the conditions such as the image densities of images, which is referred to as a start developer.

In the start developer, the image density of an image in the early stage of image formation and the amount of charge based on, for example, the presence or absence of occurrence of scattering of toner at the time of image formation are defined in addition to the above described mixing ratio of the toner to the carrier.

However, there have been conventionally problems irrespective of the above described definition that the image formed is fogged, the toner is scattered in the image formed and the image forming apparatus, and the resolution of the image formed is decreased in addition to the problem that the image density is significantly lowered as shown in FIG. 8 from the early stage of image formation to a time period during which image characteristics are stabilized (referred to as "stable time period" hereinafter) after repeating image formation approximately 3000 times.

Furthermore, when the same type of start developers are used for a plurality of image forming apparatuses, there is a problem that the degree of occurrence of defects such as fogging varies in addition to the problem that the image density varies for each image forming apparatus as image formation is repeated.

The inventors of the present application have found the following cause and effect relation between the start developer and inferior images as a result of examining the causes of occurrence of various defects from the early stage of image formation to the stable time period from various viewpoints.

More specifically, the toner density (T/D %) of the developer and an output voltage (V) of a magnetic sensor in measuring the permeability of the developer by the magnetic sensor are in the relation represented by a solid line in a graph of FIG. 7(*a*) (referred to as T/D-V characteristics hereinafter). In the conventional image forming apparatus, therefore, the permeability of the developer is measured by the sensor and the toner density is estimated from a carve of the T/D-V characteristics to control the supply of toner. That is, in this image forming apparatus, operations are programmed so as to judge that the toner density of the developer is below a predetermined value when the output voltage of the sensor exceeds a threshold value $V_T$ at which the supply of toner is started to automatically supply toner.

Meanwhile, the above threshold value $V_T$ corresponds to the output voltage of the sensor in a case where the toner density of a developer in the stable time period is $D_b$, as shown in FIG. 7(*a*). When the developer having a toner density of $D_b$ in the stable time period is used, it is found that an image having an image density $I_T$ is obtained from the relation between the toner density (T/D %) of the developer and the image density (ID) of an image transferred to a paper sheet (referred to as T/D-ID characteristics hereinafter) which is represented by a solid line in a graph of FIG. 7(*b*).

In a conventional start developer, however, the output voltage of the sensor is slightly higher or lower than that in the developer in the stable time period, so that some shift may occur between the toner density analogized from the T/D-V characteristic curve and the actual toner density. Particularly when a start developer is used in which the output voltage of the sensor is lower than that in a developer in the stable time period and the T/D-V characteristic curve is shifted on a lower voltage side from the T/D-V characteristic curve in the developer in the staple time period (represented by the solid line in FIG. 7(*a*)), as represented by a two-dot and dash line in FIG. 7(*a*), the above described defects such as lack of image density, fogging, scattering of toner and decrease in resolution are liable to occur.

The foregoing will be described in more detail.

More specifically, consider a case where the start developer in which the T/D-V characteristic curve is shifted on the lower voltage side from the T/D-V characteristic curve in the developer in the stable time period is used as described above. In this case, if toner is consumed, the toner density of the developer is gradually decreased from $D_a$ which is its initial value and correspondingly, the output voltage of the sensor is gradually increased from $V_S$ which is its initial value along the T/D-V characteristic curve represented by the two-dot and dash line. When image formation is repeated approximately 100 times, the output voltage of the sensor reaches the above described threshold value $V_T$ at which the supply of toner is started.

However, the actual toner density of the developer in which the output voltage of the sensor reaches the threshold value $V_T$ is decreased to $D_c$ which is lower than the toner density $D_b$ in the developer in the stable time period because there is some shift between the T/D-V characteristic curve (represented by the two-dot and dash line) in the start developer and the T/D-V characteristic curve (represented by the solid line) in the developer in the stable time period.

Moreover, in this start developer, a curve of T/D-ID characteristics is also shifted to the side of a lower image density (on the lower side in FIG. 7(*b*)) from the T/D-ID characteristic curve (represented by the solid line in FIG. 7(*b*)) in the developer in the stable time period, as represented by a two-dot dash line in FIG. 7(*b*).

Consequently, the image density significantly drops, as indicated by an arrow represented by a two-dot and dash line in FIG. 7(*b*), resulting in lack of image density.

Furthermore, the toner density of the start developer has been conventionally set to a higher value $D_a$ such that an image having a predetermined image density ($I_T$ as described above) can be obtained at the time of starting the use of the developer, as represented by the two-dot and dash lines in FIGS. 7(*a*) and 7(*b*). Consequently, excessive toner exists in the developer in the early stage of image formation, as compared with the developer having a toner density of $D_b$ at which an image having the same image density $I_T$ can be obtained in the stable time period. Consequently, fogging, scattering of toner and the like occur and the resolution is decreased due to the excessive toner.

After the output voltage of the sensor reaches the above described threshold value $V_T$, the following pattern is repeated. More specifically, toner is supplied when the output voltage slightly exceeds the threshold value $V_T$. After the toner is supplied, image formation is repeated. Consequently, the output voltage slightly exceeds the threshold value $V_T$, so that toner is supplied again. In addition, when image formation is repeated as described above, the T/D-V characteristics in the developer gradually approach the solid line from the two-dot and dash line, in FIG. 7(*a*).

In this stage, therefore, the output voltage of the sensor and the toner density are shifted, as represented by a zigzag line in FIG. 7(*a*). Correspondingly, the toner density and the image density are shifted, as represented by a zigzag line in FIG. 7(*b*), to gradually increase the image density. However, image formation must be repeated approximately 3000 times as described above to a time period during which the T/D-V characteristic curve in the developer coincides with the T/D-V characteristic curve in the developer in the stable time period which is represented by the solid line and the T/D-ID characteristic curve in the developer coincides with the T/D-ID characteristic curve in the developer in the stable time period, that is, the stable time period. Accordingly, during that repetition, the defects such as lack of image density shown in FIG. 8 and fogging continuously occur.

Furthermore, in the shift stage represented by the zigzag lines, a phenomenon occurs that the output voltage of the sensor is not changed irrespective of the gradual increase in the actual toner density. Accordingly, the supply of toner becomes excessive. As a result, occurrence of the defects such as fogging is promoted.

The reason why the image density varies and the degree of occurrence of defects such as fogging varies when the same type of developers are used for a plurality of image forming apparatuses is that there is a variation in characteristics between sensors therein.

More specifically, if there is a variation in characteristics between the sensors, there arises a difference between output voltages of the sensors when developers having the same permeability are measured. Consequently, the above described T/D-V characteristic curve is shifted up and down for each sensor and for each image forming apparatus, as shown in FIG. 9.

In the conventional image forming apparatuses, however, the threshold values $V_T$ have been always set to a constant value irrespective of the above described variation in characteristics between the sensors. Therefore, even if the developers having the same properties are used for a plurality of image forming apparatuses, the actual toner density of the developer in which the output voltage of the sensor reaches the threshold value $V_T$ is shifted for each image forming apparatus. As a result, the image density varies and the degree of occurrence of defects such as fogging varies for each image forming apparatus.

SUMMARY OF THE INVENTION

A primary object of the present invention is to provide a start developer whose use allows good images to be always formed from the early stage of image formation to the stable time period.

Another object of the present invention is to provide a method of controlling the toner density using the above described start developer, in which good images can be always formed irrespective of the variation in characteristics between sensors in image forming apparatuses and from the early stage of image formation to the stable time period.

The present invention provides a start developer having toner and a carrier mixed with each other in a predetermined ratio in which a predetermined image density is obtained, wherein an output voltage of a sensor in an image forming apparatus in measuring the permeability of the start developer having a particular toner density by the sensor is not less than 0.9 times an output voltage of the sensor in a developer having the same toner density in a time period during which image characteristics are stabilized after repeating image formation by the above image forming apparatus and is less than a threshold value at which the supply of toner is started.

It is preferable that the output voltage of the sensor is not less than one time the output voltage of the sensor in the developer having the same toner density in the time period during which image characteristics are stabilized after repeating image formation and is less than the threshold value at which the supply of toner is started.

In the start developer according to the present invention, the output voltage of the sensor is approximately the same as or more than the output voltage of the sensor in the developer having the same toner density in the stable time period. Accordingly, there are no defects such as lack of image density, fogging, scattering of toner and decrease in resolution which occur when the output voltage of the sensor largely falls below that in the developer in the stable time period.

Consequently, the use of the start developer according to the present invention makes it possible to always form good images from the early stage of image formation to the stable time period.

Furthermore, in accordance with another aspect of the present invention, there is provided a method of controlling the toner density using the above described start developer for an image forming apparatus, in which an output voltage $V_S$ of a sensor in the image forming apparatus in measuring the permeability of the start developer before image formation by the sensor is found, a correction voltage $\Delta V$ previously set is added to the output voltage $V_S$ on the basis of the following equation (I) to set a threshold value $V_T$ at which the supply of toner is started in the image forming apparatus and then, images are formed while measuring the permeability of the developer by the sensor in the image forming apparatus, thereby to maintain the toner density of the developer at the time of image formation within a predetermined range:

$$V_T = V_S + \Delta V \quad \text{(I)}$$

In the method of controlling the toner density according to the present invention, the threshold value $V_T$ at which the supply of toner is started is set on the basis of the foregoing equation (I) for each image forming apparatus. Accordingly, stable control can be always carried out irrespective of the variation in characteristics between sensors in image forming apparatuses. Moreover, the start developer is used in which there is no possibility of causing the above described defects such as lack of image density, fogging, scattering of toner and decrease in resolution. According to the method of controlling the toner density in the present invention, therefore, good images can be always formed irrespective of the variation in characteristics between sensors in image forming apparatuses and from the early stage of image formation to the stable time period.

As the above described correction voltage $\Delta V$, the difference between a reference value $V_S'$ of output voltages and a reference value $V_T'$ of threshold values at which the supply of toner is started in the same type of start developers is used, which is found by the following equation (II):

$$\Delta V = (V_T' - V_S') \quad \text{(II)}$$

In accordance with still another aspect of the present invention, there is provided a method of controlling the toner density using the above described start developer for an image forming apparatus, in which an output voltage $V_S$ of a sensor in the image forming apparatus in measuring the permeability of the start developer before image formation by the sensor is found, a time period elapsed until image characteristics are stabilized after repeating image formation by the image forming apparatus is divided into a plurality of time periods, that is, the first time period to the Z-th time period on the basis of the number of times of image formation, a correction voltage $\Delta V_n$ (n=1, 2, 3, . . . Z−2, Z−1, Z) gradually increased for each time period is added to the above output voltage $V_S$ on the basis of the following equation (III) to set a threshold value $V_{Tn}$ at which the supply of toner is started for each time period, and images are formed a predetermined number of times for each time period on the basis of the threshold value $V_{Tn}$:

$$V_{Tn} = V_S + \Delta V_n \quad \text{(III)}$$

In the method of controlling the toner density according to the present invention, the time period from the early stage of image formation to the stable time period is divided into a plurality of time periods on the basis of the number of times of image formation and the threshold value $V_{Tn}$ is set for each time period, thereby to make it possible to carry out finer control.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2(*a*) is a graph showing the relation between the toner density and an output voltage of a sensor in controlling the toner density in the above described control method using a start developer according to the present invention;

FIG. 2(*b*) is a graph showing the relation between the toner density and the image density in carrying out the above described control;

FIG. 7(*a*) is a graph showing the relation between the toner density and an output voltage of a sensor in controlling the toner density using a conventional start developer;

FIG. 7(*b*) is a graph showing the relation between the toner density and the image density in carrying out the above described control;

FIG. 8 is a graph showing the shift of the image density in continuously forming images using the conventional start developer; and FIG. 9 is a graph showing the shift of the relation between the toner density and an output voltage of a sensor due to the variation in characteristics between sensors.

DESCRIPTION OF THE PREFERRED EMBODIMENTS

Figure 1:
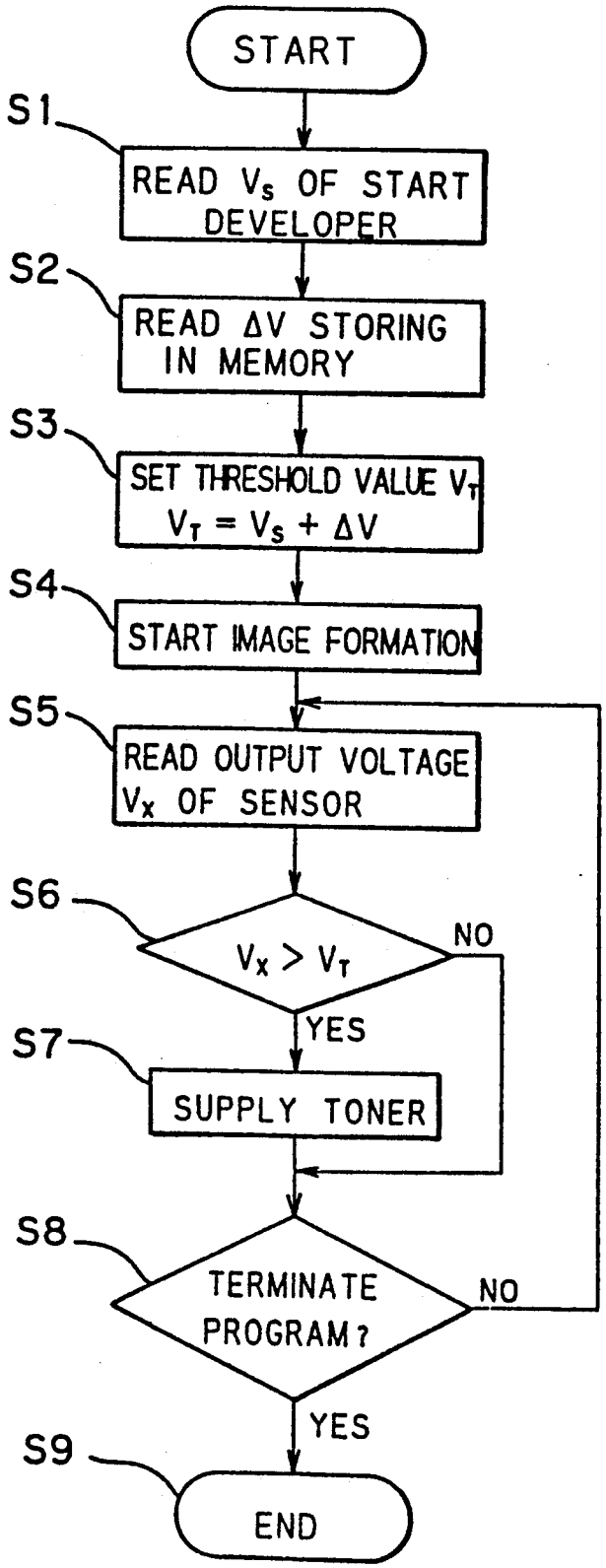
FIG. 1 is a flow chart showing one example of a method of controlling the toner density according to the present invention.

It is for the following reasons that in a start developer according to the present invention, an output voltage of a sensor is limited to not less than 0.9 times an output voltage of the sensor in a developer having the same toner density in the stable time period and less than a threshold value at which the supply of toner is started.

More specifically, when the above described output voltage of the sensor is less than 0.9 times the output voltage of the sensor in the developer in the stable time period, the difference between T/D-V characteristics in the start developer and T/D-V characteristics in the developer in the stable time period is too great, thereby causing the above described defects such as decrease in image density and fogging.

Furthermore, when the output of the sensor is not less than the threshold value at which the supply of toner is started, toner is supplied simultaneously with the start of image formation, so that toner in the developer always becomes excessive. Consequently, fogging, scattering of toner and the like occur and the resolution is decreased due to the excessive toner.

On the other hand, when the output voltage of the sensor is not less than 0.9 times and less than the output voltage of the sensor in the developer having the same toner density in the stable time period, the T/D-V characteristics in the start developer are below the T/D-V characteristics in the developer in the stable time period, but the difference therebetween is small. Accordingly, an output value of the sensor does not largely vary from the early stage of image formation to the stable time period, so that the sensor can always grasp the precise toner density.

Furthermore, when the output voltage of the sensor is one time, that is, is equal to the output voltage of the sensor in the developer having the same toner density in the stable time period, the output value of the sensor does not vary from the early stage of image formation to the stable time period, so that the sensor can always grasp the precise toner density.

Consequently, when the output voltage of the sensor is not less than 0.9 times nor more than one time the output voltage of the sensor in the developer having the same toner density in the stable time period, there is no possibility of causing defects such as decrease in image density and fogging.

Consider a case where the output voltage of the sensor exceeds one time the output voltage of the sensor in the developer having the same toner density in the stable time period and is less than the threshold value at which the supply of toner is started, as represented by a one dot and dash line in FIG. 2(*a*). In this case, if toner is consumed, the toner density of the developer is gradually decreased from $D_1$ which is its initial value and correspondingly, the output of the sensor is gradually increased from $V_S$ which is its initial value along a T/D-V characteristic curve represented by a one dot and dash line. The output voltage of the sensor reaches a threshold value $V_T$ in the stage in which the toner density of the developer is decreased to a toner density D2 higher than a toner density $D_3$ of the developer in the stable time period. Therefore, toner is supplied before the image density is significantly decreased, as indicated by an arrow represented by a one dot and dash line in FIG. 2(*b*). Accordingly, the image density is prevented from being extremely decreased, thereby to make it possible to obtain images which practically present no problem.

After the output voltage of the sensor reaches the threshold value $V_T$, the following pattern is repeated. More specifically, toner is supplied when the output voltage slightly exceeds the threshold value $V_T$. After the toner is supplied, image formation is repeated. Consequently, the output voltage slightly exceeds the threshold value $V_T$, so that toner is supplied again. In addition, when image formation is repeated as described above, the T/D-V characteristics in the developer gradually approach a solid line from the one dot and dash line, in FIG. 2(*a*).

Consequently, in this stage, the output voltage of the sensor and the toner density are shifted, as represented by a zigzag line in FIG. 2(*a*). Correspondingly, the toner density and the image density are shifted, as represented by a zigzag line in FIG. 2(*b* ), to gradually increase the image density. Consequently, the decrease in image density in the early stage of image formation is early solved.

Furthermore, in the shift stage represented by the zigzag lines, a phenomenon occurs that the output voltage of the sensor is constant and the actual toner density is gradually decreased. Consequently, a tendency to excessive toner which arises by the supply of toner at the toner density $D_2$ higher than the toner density $D_3$ of the developer in the stable time period is corrected, to prevent fogging, scattering of toner, decrease in resolution and the like due to the excessive toner.

Figure 6:
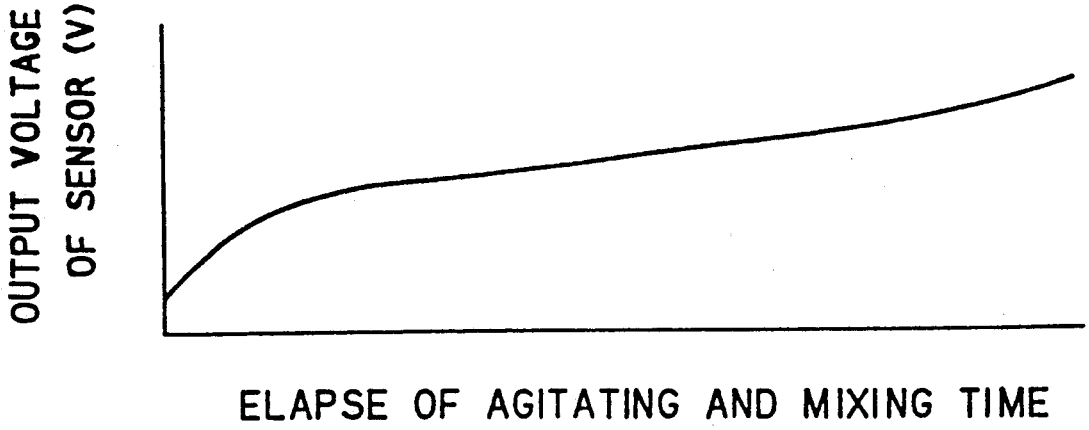
FIG. 6 is a graph showing the relation between agitating and mixing time required to produce a start developer and an output voltage of a sensor.

The output value of the sensor in the start developer tends to be gradually increased with an elapse of agitating and mixing time required to produce the start developer, as shown in FIG. 6. Consequently, in order to adjust the output value of the sensor in the start developer to be in the above described range, the toner and the carrier may be agitated and mixed while measuring the permeability of the developer by the same sensor as that used in a developing device.

It is preferable that the output value of the sensor in the start developer is one time or more in the above described range in consideration of the decrease in image density in the early stage of image formation. On the other hand, it is preferable that the output value is one time or less at which the toner and the carrier can be agitated and mixed in a shorter time period in consideration of the productivity.

The present invention is applicable to a start developer which is a combination of various types of toner and carries conventionally known.

Examples of the toner include a color particle having a particle diameter of approximately 10 μm produced by mixing additives such as a coloring agent, a charge controlling agent and a parting agent (off-set preventing agent) with a binder resin.

Examples of the binder resin include styrene resins (homopolymers or copolymers containing styrene or a styrene substitution product) such as polystyrene, chloropolystyrene, poly-α-methylstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylic ester copolymer (styrene-methyl acrylate copolymer, a styrene-ethyl acrylate copolymer, a styrene-butyl acrylate copolymer, a styrene-octyl acrylate copolymer, a styrene-phenyl acrylate copolymer and the like), a styrene-methacrylate ester copolymer (a styrene-methyl methacrylate copolymer, a styrene-ethyl methacrylate copolymer, a styrene-butyl methacrylate copolymer, a styrene-phenyl methacrylate copolymer and the like), a styrene-α methyl chloroacrylate copolymer, a styrene-acrylonitrile-acrylic ester copolymer. And also polyvinyl chloride, low molecular-weight polyethylene, low-molecular weight polypropylene, an ethylene-ethyl acrylate copolymer, polyvinyl butyral, ethylene-vinyl acetate copolymer, rosin denatured maleic acid resin, phenol resin, epoxy resin, polyester resin, ionomer resin, polyurethane resin, silicone resin, ketone resin, xylene resin, polyamide resin and the like are included. They are used independently or in combinations. Among them, styrene resins, particularly a styrene-(meta-) acrylic ester copolymer is preferable.

Examples of the coloring agent include various coloring pigments, an extender pigment, a conductive pigment, a magnetic pigment, a photoconductive pigment and the like. They are used independently or in combinations according to the usage.

The following are suitable examples of the coloring pigments:

Black: Carbon black such as furnace black, channel black, thermal, gas black, oil black, acetylene black and the like; Lamp-black; Aniline black White: Zinc white, Titanium oxide, Antimony white, Zinc sulfide Red: Red ion oxide, Cadmium red, Red lead, Mercury cadmium sulfide, Permanent red 4R, Lithol red, Pyrazolone red, Watching red calcium salt, Lake red D, Brilliant carmine 6B, Eosine lake, Rhodamine lake B, Alizarine lake, Brilliant carmine 3B Orange: Chrome orange, Molybdenum orange, Permanent orange GTR, Pyrazolone orange, Vulcan orange, Indanthrene brilliant orange RK, Benzidine orange G, Indanthrene brilliant orange GK Yellow: Chrome yellow, Zinc yellow, Cadmium yellow, Yellow iron oxide, Mineral fast yellow, Nickel titanium yellow, Naples yellow, Naphthol yellow S, Hansa yellow G, Hansa yellow 10G, Benzidine yellow G, Benzidine yellow GR, Quinoline yellow lake, Permanent yellow NCG, Tartrazine lake Green: Chrome green, Chromium oxide, Pigment green B, Malachite green lake, Fanal yellow green G Blue: Prussian blue, Cobalt blue, Alkali blue lake, Victoria blue lake, Partially chlorinated phthalocyanine blue, Fast sky blue, Indanthrene blue BC Violet: Manganese violet, Fast violet B, Methyl violet lake Examples of the expender pigment include Baryte powder, barium carbonate, clay, silica, white carbon, talc, alumina white and the like.

Examples of the conductive pigment include conductive carbon black, aluminum powder and the like.

Examples of the magnetic pigment include: triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide ($CuFe_2O_4$), lead iron oxide ($PbFe_{12}O_{19}$), neodymium iron oxide ($NdFeO_3$), barium iron oxide ($BaFe_{12}O_{19}$),magnesium iron oxide ($MgFe_2O_4$), manganese iron oxide ($MnFe_2O_4$), lanthanum iron oxide ($LaFeO_3$), iron powder, cobalt powder, nickel powder and the like.

Examples of the photoconductive pigment include zinc oxide, selenium, cadmium sulfide, cadmium selenide and the like.

The amount of the coloring agent is 1 to 20 parts by weight and preferably 3 to 15 parts by weight per 100 parts by weight of a binder resin.

As the charge controlling agent, two types of charge controlling agents, that is, one for controlling positive charges and one for controlling negative charges are used depending on the polarity of toner.

Examples of the charge controlling agent for controlling positive charges include organic compounds having a basic nitrogen atom, for example, basic dyes, aminopyrin, a pyrimidine compound, polycyclic polyamino compound, aminosilane and the like and fillers subjected to surface treatment using the above compounds.

Examples of the charge controlling agent for controlling negative charges include compounds containing a carboxyl group (for example, alkyl salicylic acid metal chelate and the like), metal complex dyes, fatty acid soap, metallic naphthenate and the like.

The amount of the charge controlling agent is 0.1 to 10 parts by weight and preferably 0.5 to 8 parts by weight per 100 parts by weight of a binder resin.

Examples of the parting agent (off-set preventing agent) include aliphatic hydrocarbon, aliphatic metallic salt, higher fatty acid, aliphatic ester or its partial sponification matter, silicone oil, various waxes and the like. Among them, aliphatic hydrocarbon having a weight average molecular weight of approximately 1000 to 10000 is preferable. More specifically, the use of one or combinations of low molecular-weight polypropylene, low molecular-weight polyethylene, paraffin wax and a low molecular-weight olefin polymer comprising an olefin unit containing four or more carbon atoms is suitable.

The amount of the parting agent is 0.1 to 10 parts by weight and preferably 0.5 to 8 parts by weight per 100 parts by weight of a binder resin.

The toner is produced by melting and kneading a mixture obtained by previously kneading the foregoing components to be uniform using a dry-blender, a Henschel mixer, a ball mill or the like to be uniform using a kneader such as a Banbury mixer, a roll, a single or twin axle extruding kneader and then, cooling and grinding a mixture obtained by kneading, and classifying the mixture as required.

The particle diameter of the toner is 3 to 35 $\mu$m and preferably 5 to 25 $\mu$m.

Examples of the carrier include particles of iron, oxidation treating iron, reducing iron, magnetite, copper, silicon steel, ferrite, nickel, cobalt and the like, particles of alloys of the materials and manganese, zinc, aluminum and the like, particles of an iron-nickel alloy, an iron-cobalt alloy and the like, particles obtained by dispersing the above various particles in a binder resin, particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate and lithium niobate, particles of materials having a high dielectric constant such as ammonium dihydrogenphosphate ($NH_4H_2PO_4$), potassium dihydrogenphosphate ($KH_2PO_4$) and Rochelle salt. Among them, iron powder of oxidation treating iron, reducing oxide and the like and ferrite powder are preferable because they are superior in image characteristics and low in cost.

Additionally, a resin coating layer can be also formed on the surface of the above described carrier for the purpose of, for example, controlling the amount of charge of toner and the polarity thereof, improving dependence on humidity and preventing film formation.

Examples of a polymer used for the resin coating layer include a (meta-)acrylic polymer, a styrene polymer, a styrene-(meta-)acrylic copolymer, an olefin polymer (polyethylene, chlorinated polyethylene, polypropylene and the like), polyvinyl chloride, polycarbonate, polyester resin, unsaturated polyester resin, polyamide resin, polyurethane resin, epoxy resin, silicone resin, fluorine resin (polytetrafluoroethylene, polychlorotrifluoroetylene, polyvinylidene fluoride and the like), phenol resin, xylene resin, diallyl phthalate resin and the like. Among them, the use of a (meta-) acrylic polymer, a styrene polymer, styrene-(meta-) acrylic copolymer, silicone resin or fluorine resin is preferable in terms of frictional electrification of toner and mechanical strength. The above described polymers can be also used independently or in combinations.

As a coating method for forming the resin coating layer made of the above described polymer on the surface of the carrier, known methods such as a fluidized bed method and a rolling method can be all employed.

The particle diameter of the carrier is 30 to 200 μm and preferably 50 to 130 μm.

The mixing ratio of the toner to the carrier may be the same as the conventional one. Furthermore, in order to improve the fluidity of the start developer, a fluidizing agent such as colloidal silica can be further mixed with the above toner and the above carrier.

As a mixing equipment used for agitating and mixing toner and a carrier, a nauter mixer, a ball mill, a V-type mixing machine and the like are exemplified.

A first manner of a method of controlling the toner density according to the present invention using the start developer according to the present invention described in the foregoing will be described while referring to a flow chart of FIG. 1 and FIGS. 2(*a*) and 2(*b*).

When a start developer having a toner density of $D_1$ according to the present invention is injected into a developing portion of an image forming apparatus to start the image forming apparatus, a sensor provided in the above developing portion measures the permeability of the start developer, so that an output voltage $V_S$ of the sensor is read in a processing unit of the image forming apparatus (step S1).

Then, a correction voltage ΔV stored in a memory is read in the processing unit (step S2). In this processing unit, an arithmetic operation is executed on the basis of the following equation (I) to set a threshold value $V_T$ at which the supply of toner is started, and this threshold value $V_T$ is stored in the memory (step S3):

$$V_T = V_S + \Delta V \quad \text{(I)}$$

Used as the above described correction voltage ΔV is a value found by the following equation (II) from a reference value $V_S'$ of output voltages and a reference value $V_T'$ of threshold values at which the supply of toner is started in the same type of start developers which are previously measured using a reference image forming apparatus:

$$\Delta V = (V_T' - V_S') \quad \text{(II)}$$

Then, when image formation is started in the step S4, the permeability of the developer is measured by the sensor, so that an output voltage $V_X$ of the sensor is read (step S5).

The read output voltage $V_X$ is compared with the previously described threshold value $V_T$ (step S6). When $V_X \leqq V_T$, that is, the output voltage $V_X$ of the sensor does not exceed the threshold value $V_T$, the program proceeds to the step S8 without passing through the step S7., On the other hand, when $V_X > V_T$, that is, the output voltage $V_X$ of the sensor exceeds the threshold value $V_T$, the program proceeds to the step S7. In the step S7, predetermined amounts of toner is supplied and then, the program proceeds to the step S8.

In the step S8, it is judged whether or not a signal for terminating this program is inputted to a control portion of the image forming apparatus. The signal for terminating the program is inputted by an operator when a trouble occurs in the developer currently used or the developer in the developing portion is replaced with a new start developer by, for example, repairing or checking the image forming apparatus.

When it is judged in the step S8 that the signal for terminating the program is inputted, the program proceeds to the step S9. In the step S9, a series of program is terminated. When this image forming apparatus is driven again using the new start developer, the program described in the foregoing is repeated again from the step S1.

On the other hand, when it is judged in the step S8 that the signal for terminating the program is not inputted, a loop returning to the step S5 from the step S8 is formed. In a time period elapsed until the signal for terminating the program is inputted, the operations in the steps S5 to S8 are repeated on the basis of data on the threshold value $V_T$ which is stored in the memory.

While the above described series of operations is repeated, the output voltage of the sensor and the toner density of the developer are shifted, as indicated by an arrow represented by a one dot and dash line in FIG. 2 (*a*).

More specifically, in the first stage of image formation, when toner is consumed by the image formation, the output voltage $V_X$ is gradually raised from $V_S$ which is its initial value to the threshold value $V_T$ along a T/D-V characteristic curve represented by a one dot and dash line in FIG. 2(*a*). During this time, the output voltage $V_X$ of the sensor does not exceed the threshold value $V_T$. Accordingly, the program proceeds in a path which does not pass through the step S7 for supplying toner. Consequently, toner is not supplied until the toner density is decreased to $D_2$.

When the output voltage $V_X$ of the sensor exceeds the threshold value $V_T$, the program is switched to a path which passes through the step S7. Consequently, predetermined amounts of toner is supplied. When the output voltage $V_X$ of the sensor becomes the threshold value $V_T$ or less by the supply of the toner, the program is switched again to the path which does not pass through the step S7. This repetition corresponds to a portion represented by a zigzag line in FIG. 2(*a*).

After a T/D-V characteristic curve in the developer coincides with a T/D-V characteristic curve in a developer in the stable time period which is represented by a solid line in FIG. 2(*a*), switching between the above described paths which passes and does not pass through the step S7 is repeated until the signal for terminating the program is inputted. In this case, the output voltage of the sensor and the toner density of the developer are shifted above and below the threshold value $V_T$ on the T/D-V characteristic curve in the developer in the stable time period which is represented by the solid line.

While the output voltage of the sensor and the toner density of the developer are shifted as described above, the image density is not extremely lowered and is shifted within a range in which images which practically present no problem can be obtained, as indicated by an arrow represented by a one dot and dash line in FIG. 2(*b*).

As described in the foregoing, according to the method of controlling the toner density shown in FIG. 1, the threshold value $V_T$ at which the supply of toner is started is set on the basis of the foregoing equation (I) for each image forming apparatus. Accordingly, stable control can be always carried out irrespective of the variation in characteristics between sensors in image forming apparatuses. Moreover, as described above, the start developer according to the present invention whose use eliminates the possibility of causing defects such as lack of image density, fogging, scattering of toner and decrease in resolution. Accordingly, good images can be always formed irrespective of the variation in characteristics between sensors in image forming apparatuses and from the early stage of image formation to the stable time period.

Meanwhile, in the above described control method, the image density is slightly decreased, as shown in FIG. 2(*b*). As described above, the decrease in image density is, of course, achieved in the range in which there is practically no problem. In order to strictly prevent the decrease in image density, a second manner of the method of controlling the toner density according to the present invention is employed in which a time period from the early stage of image formation to the stable time period is divided into a plurality of time periods and control is carried out for each time period.

The second manner of the control method according to the present invention will be described while referring to flow charts of FIGS. 3 and 4 and FIG. 5. The drawings show a case where a time period from the early stage of image formation to the stable time period is divided into five time periods, that is, the first time period to the fifth time period and control is carried out for each time period. Assuming that the total number of times of image formation from the early stage of image formation to the stable time period is 3000, the number of times thereof for each time period is 600 obtained by cutting 3000 into five equal divisions.

When a start developer having a toner density of $D_1$ according to the present invention is injected into a developing portion of an image forming apparatus to start the image forming apparatus, n in a memory for setting any one of the time periods is first reset (step S1).

Then, a sensor provided in the above developing portion measures the permeability of the start developer, so that an output voltage $V_S$ of the sensor is read in an processing unit of the image forming apparatus (step S2).

In the step S3, 1 is then added to n (=0) in the above memory, to start image formation in the first time period.

In the image formation in the first time period, a correction voltage $\Delta V_1$ in the first time period which is stored in the memory is read in the processing unit (step S4). In this processing unit, an arithmetic operation is executed on the basis of the following equation (III)' to set a threshold value $V_{T1}$ at which the supply of toner is started, and this threshold value $V_{T1}$ is stored in the memory (step S5):

$$V_{T1}=V_S+\Delta V_1 \qquad \text{(III)}'$$

Used as the above described correction voltage $\Delta/V_1$ is a value found by the following equation (IV)' from a reference value $V_S'$ of output voltages and a reference value $V_T'$ of threshold values at which the supply of toner is started in the same type of start developers which are previously measured using a reference image forming apparatus:

$$\Delta V_1=(V_T'-V_S')/5 \qquad \text{(IV)}'$$

The permeability of the developer is then measured by the sensor, so that an output voltage $V_X$ of the sensor is read (step S6).

The read output voltage $V_X$ is compared with the previously described threshold value $V_{T1}$ (step S7). When $V_X \leqq V_{T1}$, that is, the output voltage $V_X$ of the sensor does not exceed the threshold value $V_{T1}$, the program proceeds to the step S9 without passing through the step S8. On the other hand, when $V_X > V_{T1}$, that is, the output voltage $V_X$ of the sensor exceeds the threshold value $V_{T1}$, the program proceeds to the step S8. In the step S8, predetermined amounts of toner is supplied and then, the program proceeds to the step S9.

In the step S9, it is judged whether or not the number of times of image formation in the first time period reaches a predetermined number of times (600). If the number of times is less than the predetermined number of times, the program proceeds to the step S11.

In the step S11, it is judged whether or not the above described signal for terminating the program is inputted to a control portion of the image forming apparatus by an operator.

When it is judged in the step S11 that the signal for terminating the program is inputted, the program proceeds to the step S12. In the step S12, a series of program is terminated. When this image forming apparatus is driven again using a new start developer, the above described program is repeated again from the step S1.

On the other hand, when it is judged in the step S11 that the signal for terminating the program is not inputted, a loop returning to the step S6 from the step S11 (which does not pass through the step S10) is formed. In a time period elapsed until the signal for terminating the program is inputted or a time period elapsed until the number of times of image formation in the first time period reaches a predetermined number of times so that image formation in the first time period is terminated, the operations in the steps S6 to S11 are repeated on the basis of data on the threshold value $V_{T1}$ which is stored in the memory.

When it is judged in the step S9 that the number of times of image formation in the first time period reaches a predetermined number of times, the program proceeds to the step S10. In the step S10, it is judged whether or not image formation in the first to fifth time periods is terminated.

Image formation is currently in the first time period. Accordingly, it is reasonably judged in the step S10 that image formation in the first to fifth time periods is not terminated. Consequently, the program is returned to the step S3. In the step S3, 1 is added to n in the above memory, so that image formation in the second time period is started through the same procedure as described above.

Thereafter, image formation in the second to fifth time periods is repeated in the same procedure as described above, leading to the stable time period.

Used as correction voltages $\Delta V_n$ in the second to fifth time periods are values found by the following equation (IV):

$$\Delta V_n=n\,(V_T'-V_S')/5 \qquad \text{(IV)}$$

(where n in the foregoing equation represents an integer between 2 and 5)

Figure 5:
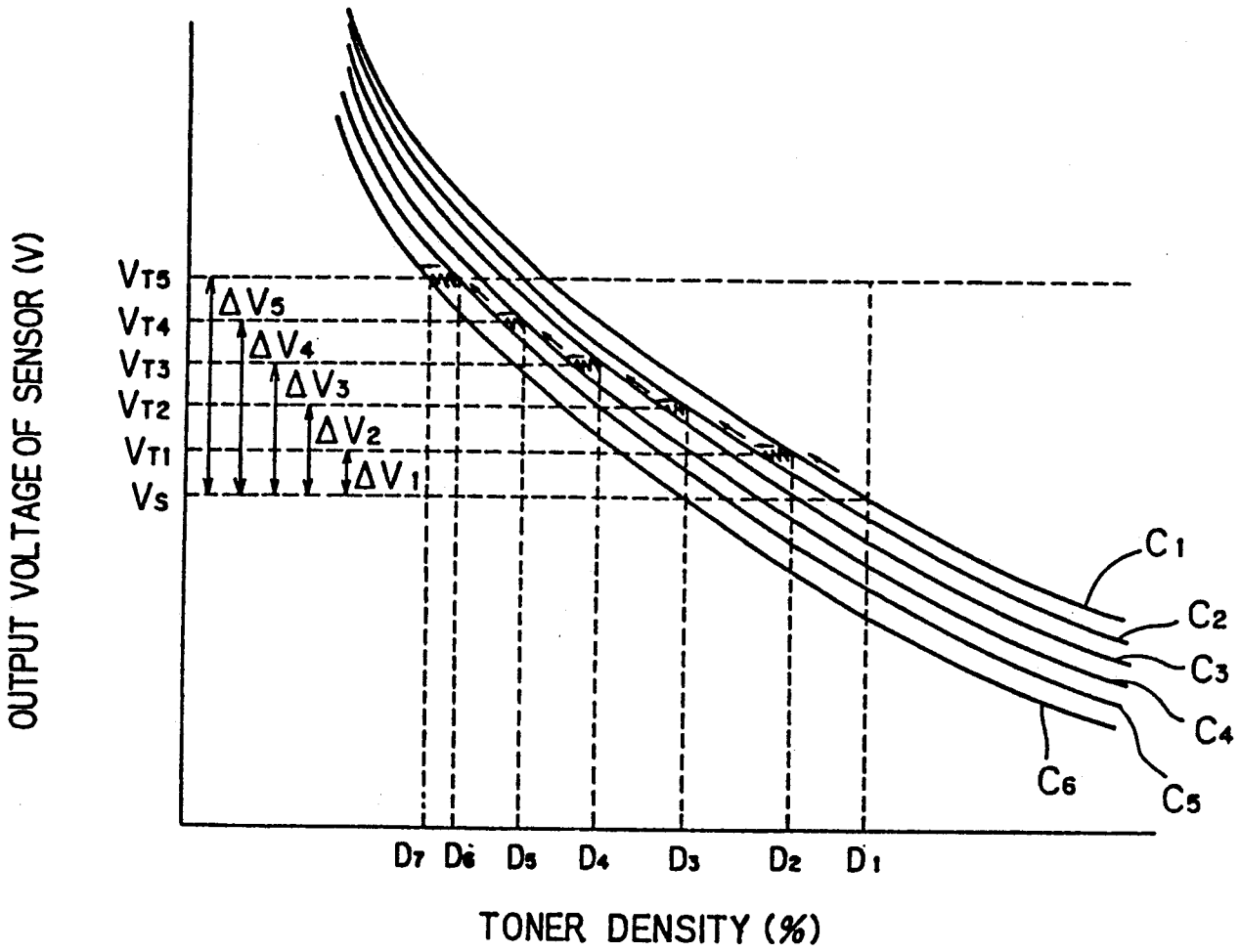
FIG. 5 is a graph showing the relation between the toner density and an output voltage of a sensor in carrying out the above described control.

The correction voltages $\Delta V_n$ found by the foregoing equation (IV) are values so set that the differences between the output voltage $V_S$ in the start developer and threshold values $V_{T1}$ to $V_{T5}$ in the respective time periods are equal to each other, as shown in FIG. 5.

When the number of times of image formation in the fifth time period reaches a predetermined number of times so that the program proceeds from the step S9 to the step S10, it is judged in the step S10 that image formation in the first to fifth time periods is terminated. Consequently, the program proceeds to the step S11. A loop from the step S6 to the step S11 through a path represented by a broken line is formed. In a time period elapsed until the signal for terminating the program is inputted, the operations are repeated on the basis of data on the threshold value $V_{T5}$ which is finally stored in the memory.

While the above described series of operations is repeated, the output voltage of the sensor and the toner density of the developer are shifted, as indicated by arrows in FIG. 5.

First, in the first time period, when toner is consumed by image formation, the output voltage $V_X$ is gradually raised from $V_S$ which is its initial value to the first threshold value $V_{T1}$ along a T/D-V characteristic curve $C_1$ shown in FIG. 5. During this time, the output voltage $V_X$ of the sensor does not exceed the threshold value $V_{T1}$. Accordingly, the program proceeds in a path which does not pass through the step S8 for supplying toner. Consequently, toner is not supplied until the toner density is decreased to $D_2$.

When the output voltage $V_X$ of the sensor exceeds the threshold value $V_{T1}$, the program is switched to a path which passes through the step S8, so that predetermined amounts of toner is supplied. When the output voltage $V_X$ of the sensor becomes the threshold value $V_{T1}$ or less by the supply of the toner, the program is switched again to the path which does not pass through the step S8. By this repetition, a T/D-V characteristic curve in the developer gradually approaches a T/D-V characteristic curve $C_2$ shown in FIG. 5 as indicated by a zigzag line, to coincide with the curve $C_2$ in the stage in which image formation in the first time period is terminated.

A new threshold value $V_{T2}$ is set, so that image formation in the second time period is started. Thereafter, image formation in the second to fifth time periods is repeated in the same procedure as described above on the basis of T/D-V characteristic curves $C_2$ to $C_6$ and threshold values $V_{T2}$ to $V_{T5}$. Simultaneously with the termination of image formation in the fifth time period, the T/D-V characteristic curve in the developer coincides with the T/D-V characteristic curve $C_6$ in the developer in the stable time period, leading to the stable time period.

After the T/D-V characteristic curve in the developer coincides with the T/D-V characteristic curve $C_6$ in the developer in the stable time period, image formation is repeated along the loop from the step S6 to the step S11 through the path represented by the broken line as described above until the signal for terminating the program is inputted. In this case, the output voltage of the sensor and the toner density of the developer are shifted above and below the threshold value $V_T$ on the T/D-V characteristic curve in the developer in the stable time period which is represented by a solid line.

Figure 3:
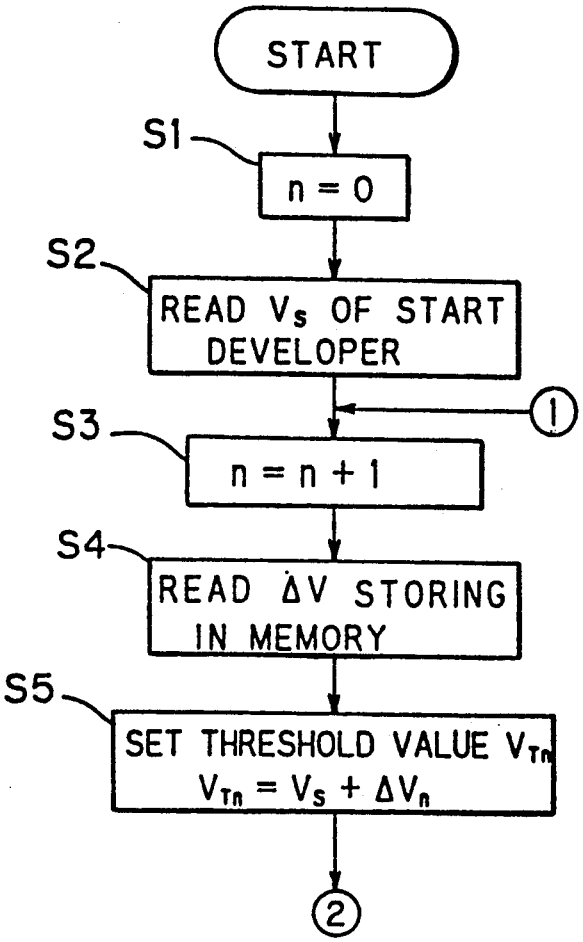
FIG. 3 is a flow chart showing the first half in another example of the method of controlling the toner density according to the present invention.
Figure 4:
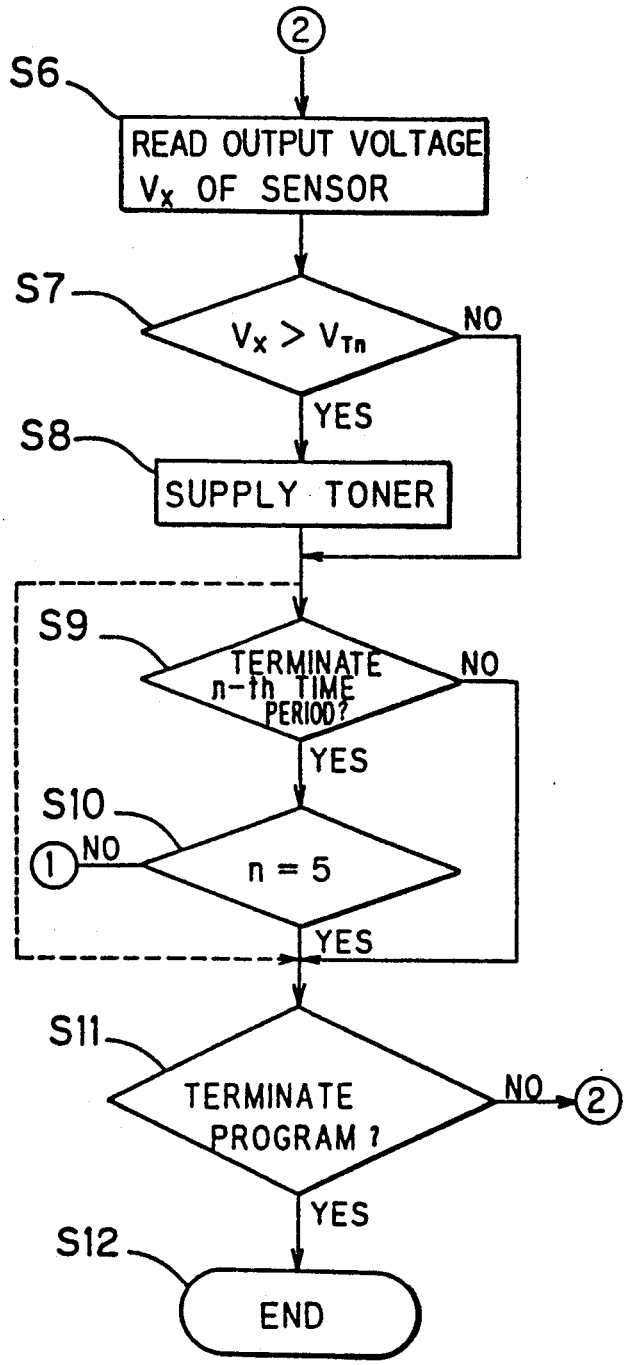
FIG. 4 is a flow chart showing the second half in the above described control method.

As described in the foregoing, according to the method of controlling the toner density shown in FIGS. 3 and 4, a time period from the early stage of image formation to the stable time period is divided into a plurality of time periods on the basis of the number of times of image formation, and a threshold value $V_{Tn}$ is set for each time period. Accordingly, finer control can be carried out. More specifically, toner can be supplied earlier, as compared with the control method shown in FIG. 1, thereby to make it possible to prevent the decrease in image density more reliably.

Although in FIGS. 3 to 5, the time period from the early stage of image formation to the stable time period is divided into five time periods, that is, the first time period to the fifth time period, the time period may be divided into a plurality of time periods, that is, four or less time periods or six or more time periods.

EXAMPLES

The present invention will be described on the basis of embodiments and a comparative example.

EMBODIMENTS 1 TO 3 AND COMPARATIVE EXAMPLE 1

Toner and a carrier having the following composition are mixed in a weight ratio of 3.5 to 96.5 and are agitated and mixed using a nauter mixer (trade name NX-S, product of Hosokawa Mikuron Co., Ltd.), to produce a start developer having a sensor output magnification of $M_V$ shown in Table 1, where $M_V$ is an output voltage $V_S$ in a start developer divided by an output voltage in a developer having the same toner density in the stable time period.

| | |
|---|---|
| *Toner (having a central particle diameter of 10 μm) | |
| styrene-acrylic copolymer | 100 parts by weight |
| carbon black | 8.5 parts by weight |
| monoazo dye | 2 parts by weight |
| low molecular-weight polypropylene | 3 parts by weight |
| *Carrier (having a central particle diameter of 100 μm) | |
| iron powder | 99.7 parts by weight |
| styrene-acrylic copolymer | 0.3 parts by weight |

The following tests are performed with respect to the start developers in the above described embodiments and comparative example.

MEASUREMENT OF IMAGE DENSITY

Continuous copy of a solid-black document is made using the above described start developer for an electrophotographic copying machine (DC-5585, product of Mita Industrial Co., Ltd.) and using the same toner as that used in the above described embodiments and comparative example as toner for supply in accordance with the flow chart of FIG. 1. The densities of copy images in the early stage of copy (on the first to 10-th paper sheets), a copy image on the 100-th paper sheet and a copy image on the 100000-th paper sheet are measured using a reflection densitometer (trade name TC-6D, product of Tokyo Densyoku Co., Ltd.).

MEASUREMENT OF FOG DENSITY

Continuous copy of a black-and-white document is made using the above described start developer for the same electrophotographic copying machine as described above and using the same toner as that used in the embodiments and the comparative example as toner for supply in accordance with the flow chart of FIG. 1. The densities in margin portions of copy images in the early stage of copy (on the first to 10-th paper sheets) and a copy image on the 100000-th paper sheet are measured as fog densities using the reflection densitometer (trade name TC-6D, product of Tokyo Densyoku Co., Ltd.).

MEASUREMENT OF RESOLUTION

Continuous copy of a chart for measuring resolution conforming to the JIS B 7174-1962 standard is made using the above described start developer for the same electrophotographic copying machine as described above and using the same toner as that used in the embodiments and the comparative example as toner for supply in accordance with the flow chart of FIG. 1, to find the resolution (the number of lines/mm) of a copy image on the 100000-th paper sheet.

TEST ON SCATTERING OF TONER

The margin portion of the copy image on the 100000-th paper sheet used in the above described measurement of resolution and the interior of the electrophotographic copying machine after making 100000 copies are observed, to evaluate as ○ a case where scattering of toner is hardly observed in both the margin portion of the copy image and the interior of the electrophotographic copying machine and as × a case where scattering of toner is observed in at least one of the margin portion of the copy image and the interior of the electrophotographic copying machine.

The foregoing results are shown in Table 1.

TABLE 1

| | Sensor Output Magnification of Mv | Image Density Initial Stage | Image Density 100-th | Image Density 100,000-th | Fog Density Initial Stage | Fog Density 100,000-th | Resolution (lines/mm) | Toner Scattering |
|---|---|---|---|---|---|---|---|---|
| Example 1 | 1.09 | 1.37 | 1.38 | 1.36 | 0.001 | 0.001 | 3.6 | ○ |
| Example 2 | 1.01 | 1.35 | 1.35 | 1.34 | 0.001 | 0.001 | 3.6 | ○ |
| Example 3 | 0.92 | 1.33 | 1.31 | 1.33 | 0.001 | 0.001 | 3.6 | ○ |
| Comparative Example 1 | 0.85 | 1.31 | 1.25 | 1.38 | 0.003 | 0.006 | 2.0 | X |
| Comparative Example 2 | 1.14 | 1.40 | 1.38 | 1.23 | 0.005 | 0.002 | 2.8 | ○ |

As can be seen from the results in the comparative example 1 in the foregoing Table 1, the densities of images on approximately 100 paper sheets largely drop from the density of an image in the early stage of image formation, there occurs fogging which is considered to be due to insufficient agitation and mixing when the sensor output magnification $M_V$ is less than 0.9. In addition, fogging and scattering of toner occur in the stable time period of image formation, so that the resolution of an image in the stable time period is low.

On the other hand, in any one of the start developers in the embodiments 1 to 3, the densities of images are always stable and there occur no fogging and scattering of toner, so that the resolution is high. Consequently, it becomes clear that the use of the start developer having a sensor output magnification of 0.9 or more according to the present invention allows stable images to be always formed from the early stage of image formation to the stable time period.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of controlling the toner density using a start developer having toner and carrier mixed in a predetermined ratio in which a predetermined image density is obtained, wherein an output voltage of a sensor in an image forming apparatus in measuring the permeability of the start developer having a particular toner density by the sensor is not less than 0.9 times an output voltage of the sensor in a developer having the same toner density in a time period during which image characteristics are stabilized after repeating image formation by the image forming apparatus and is less than a threshold value at which the supply of the toner is started, for an image forming apparatus, in which an output voltage $V_S$ of a sensor in the image forming apparatus in measuring the permeability of the start developer before image formation by the sensor is found, a previously set correction voltage $\Delta V$ is added to the output voltage $V_S$ on the basis of the following equation (I) to set a threshold value $V_T$ at which the supply of toner is started in the image forming apparatus and then, images are formed while measuring the permeability of the developer by the sensor in the image forming apparatus, thereby to maintain the toner density of the developer at the time of image formation within a predetermined range:

$$V_T = V_S + \Delta V \quad \text{(I)}$$

2. The method according to claim 1, wherein the correction voltage $\Delta V$ is the difference between a reference value $V_S'$ of output voltages and a reference value $V_T'$ of threshold values at which the supply of toner is started in the same type of start developers, which is found in the following equation (II):

$$\Delta V = (V_T' - V_S') \quad \text{(II)}$$

3. A method of controlling the toner density using the start developer according to claim 1 for an image forming apparatus, in which an output voltage $V_S$ of a sensor in the image forming apparatus in measuring the permeability of the start developer before image formation by the sensor is found, a time period elapsed until image characteristics are stabilized after repeating image formation by the image forming apparatus is divided into a plurality of time periods, that is, the first time period to the Z-th time period on the basis of the number of times of image formation, a correction voltage $\Delta V_n$ (n=0, 1, 2, 3, . . . Z−2, Z−1, Z) gradually increased for each time period is added to the output voltage $V_S$ on the basis of the following equation (III) to set a threshold value $V_{Tn}$ at which the supply of toner is started for each time period, and images are formed a predetermined number of times for each time period on the basis of the threshold value $V_{Tn}$:

$$V_{Tn} = V_S + \Delta V_n \quad \text{(III)}$$

* * * * *